US005497643A

United States Patent [19]

Koch et al.

[11] Patent Number: 5,497,643

[45] Date of Patent: Mar. 12, 1996

[54] REMOTE BENDING APPARATUS

[75] Inventors: Richard L. Koch; Alan C. Gray, both of Auburn, Nebr.

[73] Assignee: ARS Corporation, Auburn, Nebr.

[21] Appl. No.: 198,796

[22] Filed: Feb. 16, 1994

[51] Int. Cl.[6] ..... B21D 7/022

[52] U.S. Cl. ..... 72/217; 72/321; 72/702

[58] Field of Search ..... 72/217–219, 387, 72/388, 319–321

[56] References Cited

U.S. PATENT DOCUMENTS

| | | | |
|---|---|---|---|
| 1,512,002 | 10/1924 | Kardong | 72/388 |
| 1,642,657 | 9/1927 | Frick | 72/219 |
| 2,272,740 | 2/1942 | Fader | 72/312 |
| 2,492,360 | 12/1949 | English | 72/217 |
| 2,722,858 | 11/1955 | Oyen | 72/217 |
| 2,852,063 | 9/1958 | Klamm | 72/315 |
| 3,661,002 | 5/1972 | Peddinghaus | 72/217 |
| 4,515,004 | 5/1985 | Jaenson | 72/388 |
| 4,594,875 | 6/1986 | Schweitzer | 72/389 |
| 4,794,779 | 1/1989 | Schweitzer | 72/389 |
| 4,876,877 | 10/1989 | White | 72/388 |
| 4,887,447 | 12/1989 | Schweitzer | 72/332 |
| 4,890,469 | 1/1990 | Dischler | 72/218 |
| 4,989,429 | 2/1991 | Del Fabro et al. | 72/307 |

FOREIGN PATENT DOCUMENTS

| | | | |
|---|---|---|---|
| 917349 | 8/1954 | Germany | 72/217 |
| 317221 | 4/1934 | Italy | 72/219 |
| 94718 | 5/1922 | Switzerland | 72/217 |
| 884789 | 11/1981 | U.S.S.R. | 72/217 |

*Primary Examiner*—Daniel C. Crane

*Attorney, Agent, or Firm*—Zarley, McKee, Thomte, Voorhees & Sease; Mark D. Frederiksen

[57] ABSTRACT

A remotely positionable bending apparatus includes a support platform with a mandrel mounted to a front surface thereof and a bending arm pivotally connected between the mandrel and support platform. The outer end of the bending arm rotates around the upper end of the mandrel to bend a rod into a generally inverted U-shape. A clamping apparatus is operably mounted on the platform adjacent the mandrel and includes an actuator which is operated by movement of the bending arm to clamp and release a detector rod in a retained position against the mandrel. Preferably, the actuator includes a shaft which is placed under a biasing force to urge the shaft into a clamped position, with a pivotable lever connected thereto actuatable to overcome the biasing force and release a detector rod from the clamped position. The actuator lever is located in the pivotal path of the bending arm, such that movement of the bending arm to a retracted position disengages the clamping apparatus from the detector rod.

6 Claims, 3 Drawing Sheets

REMOTE BENDING APPARATUS

TECHNICAL FIELD

The present invention relates generally to an apparatus for bending metal rods and bars, and more particularly to an improved bending apparatus with a single cylinder for actuating a holding clamp and a bending arm on a remote housing.

BACKGROUND OF THE INVENTION

Nuclear detectors are uranium fission chambers housed within stainless steel pipe, and are utilized in nuclear reactors. Typically, such detectors are formed of ¾ inch pipe of approximately 40 feet in length. Because the detectors are highly radioactive, they are maintained under water to shield radiation.

In the prior art, detectors were conventionally cut in half and stored randomly under water. Because this resulted in handling, storage and accountability concerns, various tools were devised to bend the detectors into an inverted U-shape such that the detectors may be easily supported at the bend and quickly and easily transferred to storage under water.

While bending tools are known in the prior art, they suffer several drawbacks. First, conventional bending tools utilize one hydraulic cylinder to clamp the detector into position, and a separate hydraulic cylinder to bend the detector in half. The use of two separate cylinders to accomplish these two tasks requires a large number of hoses, controls, and related accessories, thereby requiring a high degree of maintenance. In addition, with independently controlled cylinders, it is possible that one cylinder can fail while the other cylinder continues to be operable. Thus, it is possible that a detector may not be adequately clamped during the bending process, producing a very hazardous condition.

Another problem with prior art bending tools is in their use of a hydraulic cylinder to power the bending arm, and a separate pneumatic cylinder to clamp the detector into position. The use of a separate hydraulic cylinder requires a separate pump, reservoir, and controls for operation in addition to the air compressor necessary to provide pressure to the pneumatic cylinder.

SUMMARY OF THE INVENTION

It is therefore a general object of the present invention to provide an improved remote bending apparatus for bending spent nuclear detectors and the like.

Another object of the present invention is to provide a remote bending apparatus which utilizes a single cylinder to operate both a holding clamp and the bending arm.

Still another object is to provide a remote bending apparatus which does not require the additional controls and accessory items of a hydraulic cylinder driven system.

Another object of the present invention is to provide a remote bending apparatus which is simple to construct, maintain, and operate.

These and other objects will be apparent to those skilled in the art.

The remotely positionable bending apparatus of the present invention includes a support platform with a mandrel mounted to a front surface thereof and a bending arm pivotally connected between the mandrel and support platform. The outer end of the bending arm rotates around the upper end of the mandrel to bend a rod into a generally inverted U-shape. A clamping apparatus is operably mounted on the platform adjacent to the mandrel and includes an actuator which is operated by movement of the bending arm to clamp and release a detector rod in a retained position against the mandrel. Preferably, the actuator includes a shaft which is placed under a biasing force to urge the shaft into a clamped position, with a pivotable lever connected thereto actuatable to overcome the biasing force and release a detector rod from the clamped position. The actuator lever is located in the pivotal path of the bending arm, such that movement of the bending arm to a retracted position disengages the clamping apparatus from the detector rod.

DESCRIPTION OF THE PREFERRED EMBODIMENT

Figure 1:
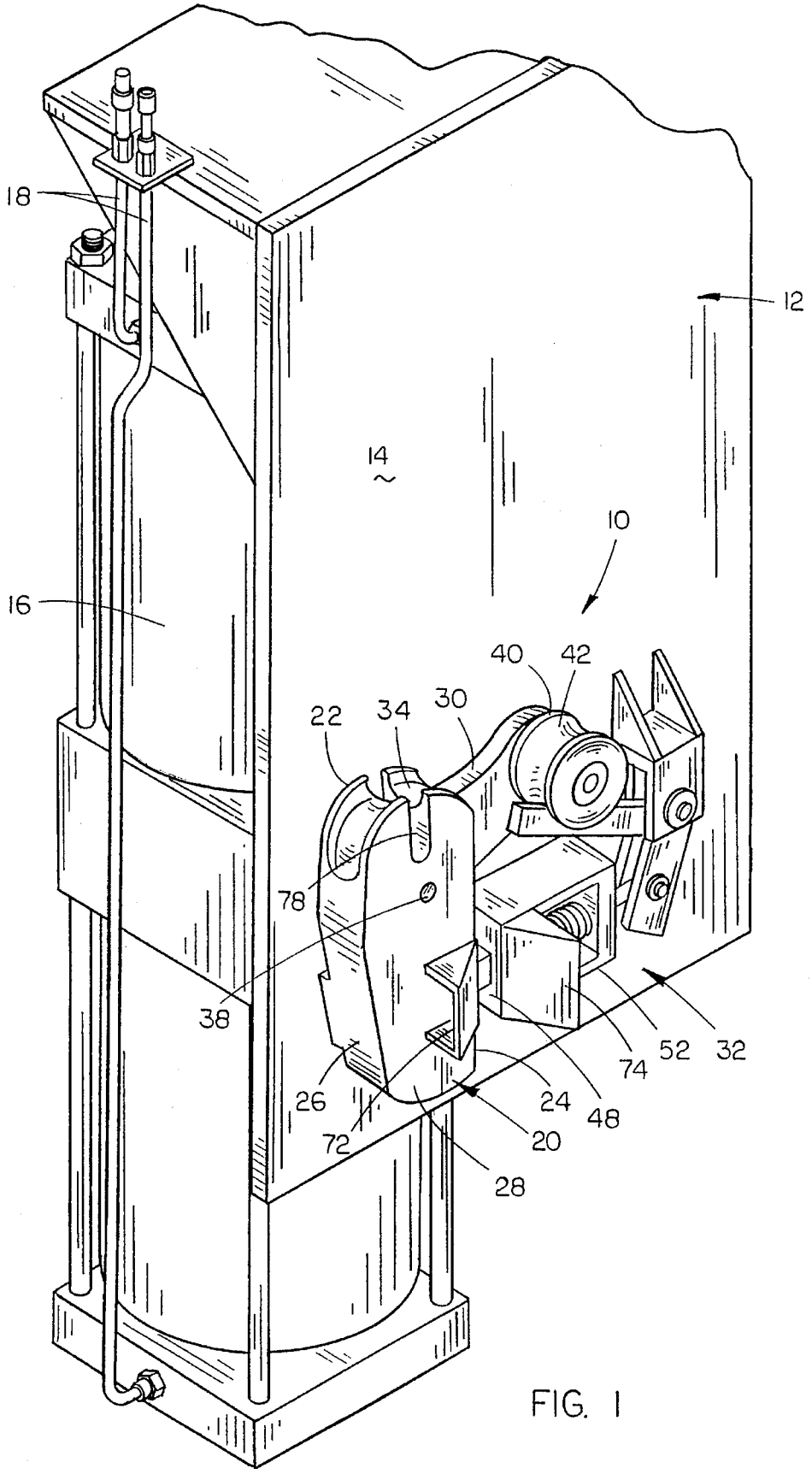
FIG. 1 is a perspective view of the bending apparatus of the present invention mounted on a support platform.

Referring now to the drawings, in which similar or corresponding parts are identified with the same reference numeral, and more particularly to FIG. 1, the remote bending apparatus of the present invention is designed generally at 10 and is shown mounted on a movable platform 12 which may be moved into position to retain and bend a detector.

Platform 12 includes a vertical support plate 14 with the bending apparatus 10 mounted on the front surface thereof. A pneumatic cylinder 16 is mounted on the rearward surface of plate 14, and has a pair of air lines 18 extending therefrom which supply power to cylinder 16.

Bending apparatus 10 includes a mandrel 20 mounted to the forward surface of plate 14 and includes an upper bending surface 22, a first vertical side wall 24, and opposing generally vertical side wall 26 and a forward surface 28. The upper end of mandrel 20 is spaced away from plate 14 to permit rotational movement of a bending arm 30 between the mandrel and plate 14. A clamping apparatus 32 is mounted to plate 14 adjacent the first mandrel side wall 24, and serves to clamp a detector in place during the bending operation.

Mandrel 20 provides a stationary support about which a detector rod is bent. Bending surface 22 includes a groove 34 with a radius approximately the same as a detector rod 36 (shown in FIGS. 2–5) to be bent, and with a longitudinal axis which is generally semi-circular and extends from first side wall 24 to second side wall 26.

Figure 2:
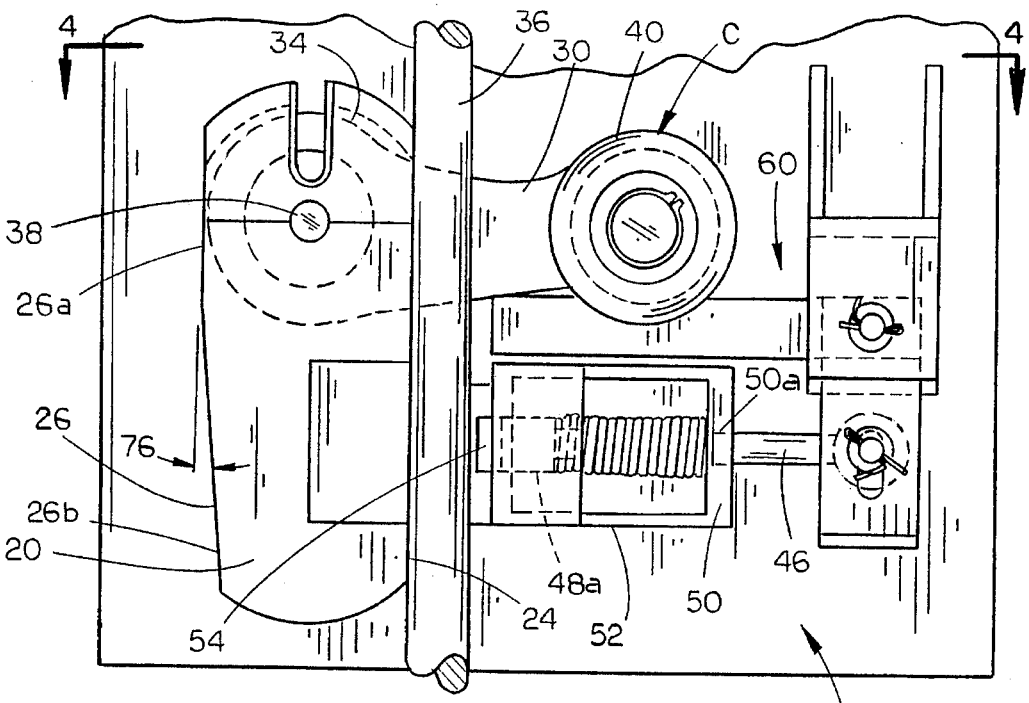
FIG. 2 is a front elevational view of the bending apparatus.
Figure 3:
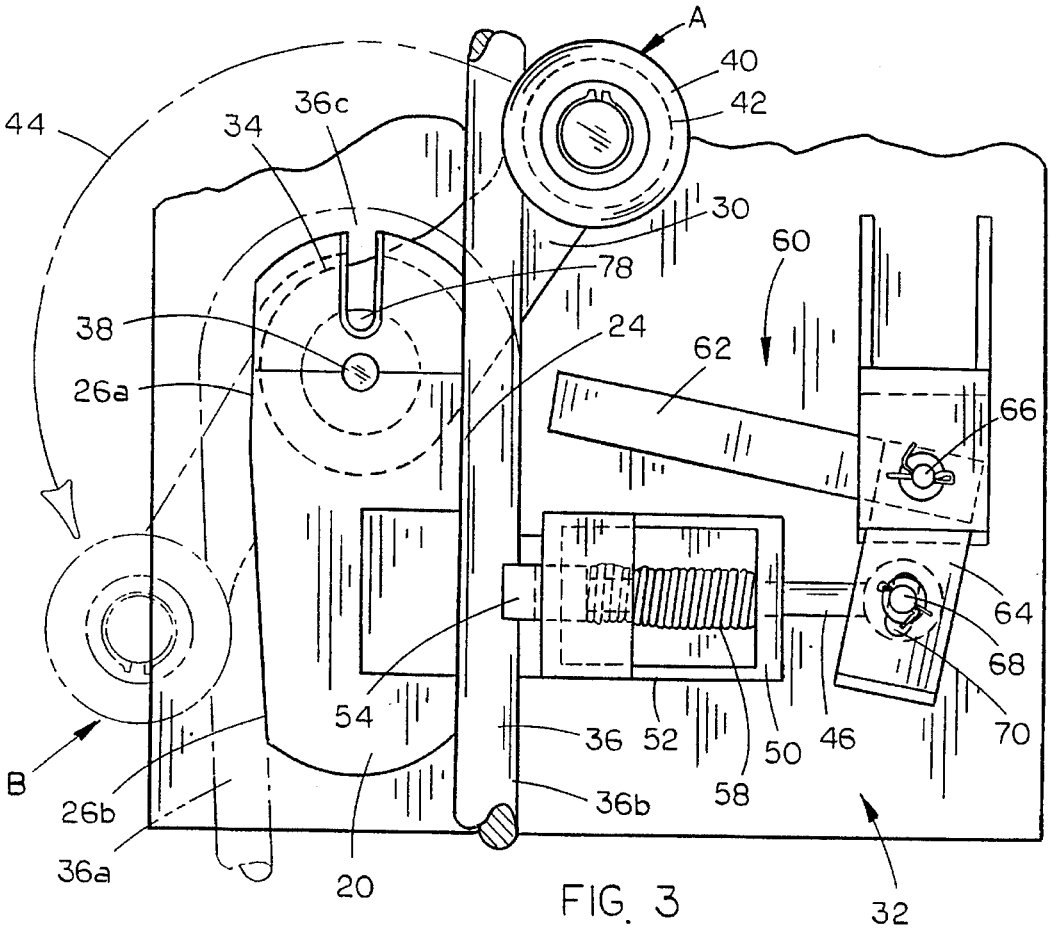
FIG. 3 is a front elevational view similar to FIG. 2, but with the bending arm moved to a second position.

An actuator shaft 38 extends through plate 14 to interconnect a rack and pinion rotary actuator (not shown) driven by cylinder 16, with bending arm 30. Actuator shaft 38 extends through bearing arm 30 and into an aperture through mandrel 22. As shown in FIGS. 2 and 3, actuator shaft 38 is located centrally between side walls 24 and 26 of mandrel 20, and forms the center of the radius of the longitudinal axis of groove 34. One end of bending arm 30 is affixed to actuator shaft 38 for rotational movement therewith. While the opposite end projects radially from actuator shaft 38.

A roller 40 is rotatably mounted on the projecting end of bending arm 30 and has an annular groove 42 with the same radius as the detector rod 36 around the circumference thereof. As shown in FIGS. 2 and 3, groove 42 in roller 40 ensures positive engagement and smooth bending of detector rod 36 as bending arm 30 is rotated on actuator shaft 38. As shown in FIGS. 2 and 3, bending arm 30 is rotatable between an initial release position, shown in FIG. 2, through approximately 210° of rotation to a fully engaged position, shown in broken lines in FIG. 3, the path of the bending arm shown by arrow 44.

Figure 4:
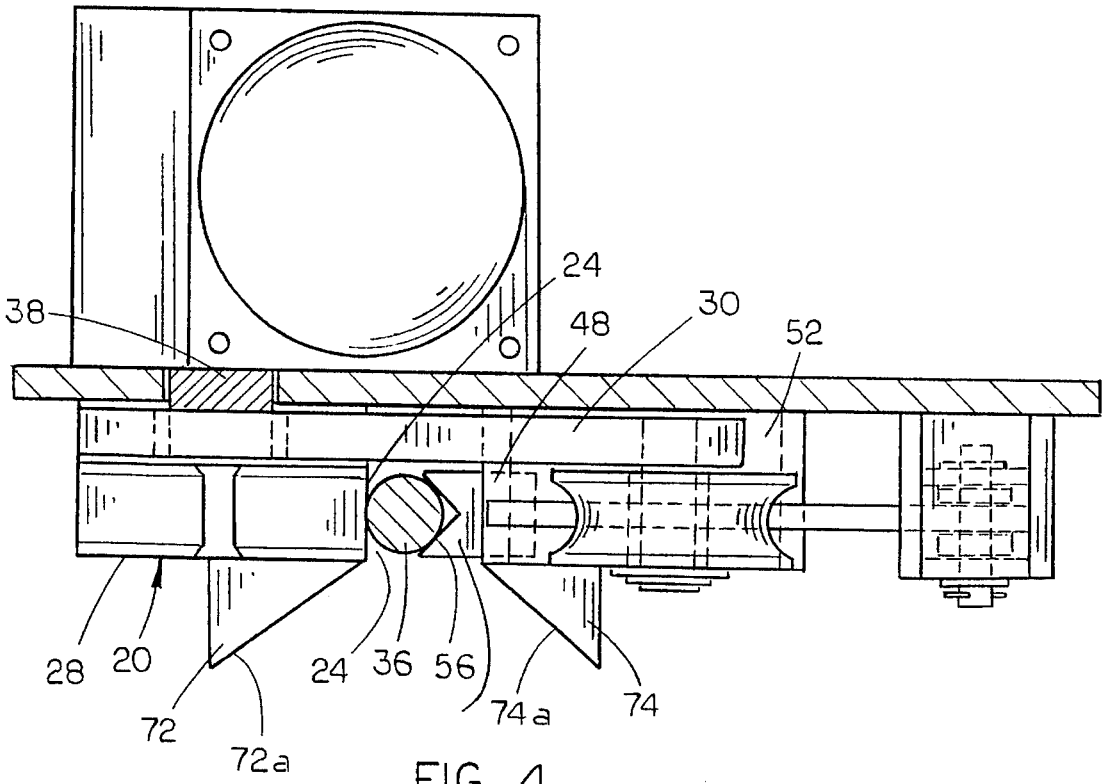
FIG. 4 is a sectional view taken at lines 4—4 in FIG. 2.

Referring now to FIGS. 2 and 3, clamping apparatus 32 includes a shaft 46 slidably journaled through apertures 48*a* and 50*a* in forward and rearward walls 48 and is 50 of a shaft support bracket 52. The forward end of shaft 46 has a clamping block 54 affixed thereto with a vertically oriented V-shaped groove 56 formed in the forward surface thereof (as shown in FIG. 4) which will engage a portion of the circumference of detector rod 36 when shaft 46 is actuated to a clamping position (shown in FIGS. 3 and 4). As best shown in FIG. 4, clamping block 54 will apply force against rod 36 to retain the rod in position against first side wall 24 of mandrel 20, so as to firmly retain rod 36 in position.

Shaft 46 and clamping block 54 are actuated to the forward clamping position by the biasing force of coil spring 58, which is operably mounted on shaft 46 between clamping block 54 and rearward wall 50 of support bracket 52. Coil spring 58 is designed to provide a predetermined clamping force on rod 36, which may be overcome so as to release rod 36 by actuation of a release lever 60.

Release lever 60 is generally L-shaped, with a long leg 62 and a short leg 64, and is pivotally mounted on a pin 66 at the juncture of legs 62 and 64. A pin 68 affixed perpendicularly to the rearward end of shaft 46 projects through a slot 70 formed in short leg 64 of lever 60, such that pivotal movement of lever 60 on pivot pin 66 will extend or retract shaft 46 in bracket 52.

As shown in FIGS. 2 and 3, the projecting forward end of the long leg 62 of release lever 60 extends into the path of movement of bending arm 30 such that movement of bending arm 30 to the release position shown in FIG. 2 will pivot lever 60 and retract shaft 46 and clamping block 54 away from detector rod 36 to permit removal of rod 36 from mandrel 20.

As shown in FIGS. 1 and 4, a pair of wedge-shaped guide members 72 and 74 are mounted on the forward surface 28 of mandrel 20 and a forward surface of the forward wall 48 of support bracket 52, respectively. Guide members 72 and 74 include a sloped surface 72*a* and 74*a*, respectively, oriented to direct a detector rod 36 towards the opening between mandrel side wall 24 and support bracket forward wall 48.

Referring once again to FIG. 1, platform 12 is preferably supported by a cable to hang vertically from a hoist (not shown), so as to permit movement of support platform 12 in a position remote from the hoist. Cylinder 16 is provided with air pressure through air lines 18 which are connected to a conventional air compressor available on the hoist's operating platform. Pneumatic rotary actuator 16 is a dual action cylinder preferably operable on air pressure of approximately 100 pounds, to rotate bending arm 30 in both directions about actuator shaft 38.

As discussed above, the bending apparatus of the present invention is preferably utilized in the environment of a nuclear reactor, wherein detector rods are handled under water. In operation, a detector rod is initially raised out of a reactor utilizing existing conventional handling tools. The detector rod is maintained under water at all times. Platform 12 is then lowered under water to a position wherein bending apparatus 10 is located generally at the midpoint of the vertically oriented detector rod to be bent. The detector rod 36 (as shown in FIG. 2) is then moved towards bending apparatus 10 and guided into the position shown in FIG. 2 by guide members 72 and 74 (shown in FIGS. 1 and 4).

Once detector rod 36 is appropriately positioned, as shown in FIG. 2, bending arm 30 is activated to raise from the release position shown in FIG. 2 to an initial clamped position shown in FIG. 3. Movement of bending arm upwardly releases lever 60 so as to permit coil spring 58 to move clamping block 54 into engagement with detector rod 36, as shown in FIGS. 3 and 4. Thus, detector rod 36 is securely clamped in position by the time bending arm 30 reaches the initial engagement position shown in solid lines in FIG. 3.

Figure 5:
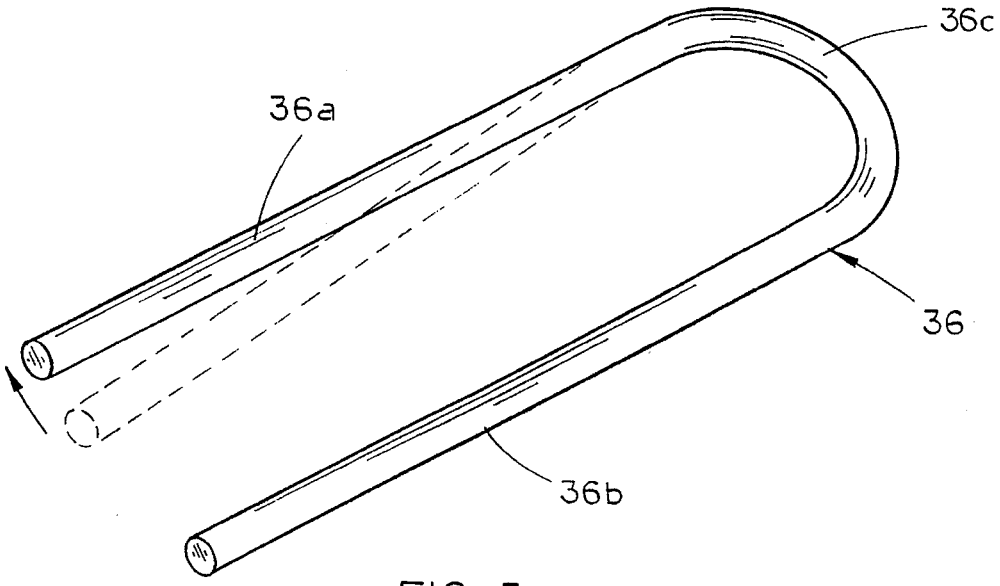
FIG. 5 is a perspective view of a rod bent utilizing the bending apparatus of the present invention.

Once the detector handling tool is removed from detector rod 36, bending arm 30 is actuated so as to move from the initial engagement position A to the fully engaged position B, shown in FIG. 3, with the upper end 36*a* in abutting contact with side wall 26 of mandrel 20. It should be noted that side wall 26 includes upper and lower portions 26*a* and 26*b*, as shown in FIG. 2, with upper portion 26*a* generally parallel to side wall 24, and lower portion 26*b* angled at approximately 3° beyond the vertical, shown by angle 76 in FIG. 2. As shown in FIG. 5, it is necessary to bend detector rod 36 more than 180° as shown by the broken lines, because the resiliency of the metal material of rod 36 will cause upper end 36*a* to return slightly outwardly when the bending arm is released from the fully engaged position B (shown in FIG. 3). Thus, in order to obtain a generally inverted U-shape, with rod ends 36*a* and 36*b* parallel, rod end 36*a* must be initially bent to a position angled slightly towards rod end 36*b*, prior to release of the rod.

Upon completion of the bend, platform 12 is moved to a predetermined storage location and bending arm 30 is retracted from fully engaged position B (see FIG. 3), past initial contact position A, to the release position C shown in FIG. 2. In release position C, roller 40 engages release lever 60 to retract clamping block 54 and thereby permit removal of detector rod 36.

A vertical slot 78 formed in the upper end of mandrel 20 and extending downwardly into upper bending surface 22 and groove 34 permits a hook to be inserted under the bent portion 36*c* of detector rod 36, as shown in FIG. 3, to lift rod 36 off of mandrel 20 and place detector rod 36 in a designated storage position.

Whereas the invention has been shown and described in connection with the preferred embodiment thereof, it will be understood that many modifications, substitutions and additions may be made which are within the intended broad scope of the appended claims.

We claim:

1. A remotely positionable bending apparatus, comprising:

a support platform with a mandrel mounted thereon, said mandrel having a front surface, an upper end with an arcuate bending surface, a lower end, a first straight side wall and an opposing second side wall;

said mandrel second side wall includes a straight upper portion and a straight lower portion, the upper portion oriented generally parallel to said mandrel first side wall, and the second side wall lower portion sloped towards the first side wall from the upper side wall portion to the lower end of the mandrel, such that a rod bent around the first side wall, the mandrel bending surface, and the mandrel second side wall is bent slightly beyond the shape of an inverted U before being released;

a bending arm with a first end pivotally connected to said platform adjacent said mandrel and a second end projecting outwardly from said mandrel;

means on said bending arm second end for engaging and bending a rod;

selectively operable drive means connected to said bending arm for pivoting said bending arm among a first position projecting generally perpendicularly outwardly relative to the mandrel first side wall, a second position located closely adjacent the mandrel second side wall, and an intermediate position between the first and second positions such that said engaging means of said bending arm moves towards said second side wall lower portion to cause said rod to be bent against said lower portion;

a support bracket mounted on said platform, having a forward wall spaced apart from said mandrel first side wall to form a rod receiving space therebetween, and a rearward wall spaced rearwardly from the forward wall;

a shaft having a forward end projecting forwardly through an aperture in the forward wall, and a rearward end projecting rearwardly through an aperture in the rearward wall, said shaft slidably journaled through said forward and rearward wall apertures for movement between a forward, clamped position, and a rearward, unclamped position;

said shaft forward end including a block with a forward face located to engage a rod in the rod receiving space when the shaft is in the clamped position, said block forward face having a vertically oriented groove formed therein to receive a portion of a rod;

biasing means connected to said shaft and operable independent of the bending arm, for asserting a biasing force on said shaft in a forward direction to operate the shaft to the clamped position;

a lever operable between first and second positions, having a first end connected to said second end of said shaft and movable therewith, and a second end located in the pivotal path of said bending arm and located such that movement of the bending arm from the intermediate position to the first position operates the lever to slide the shaft against the force of the biasing means to the unclamped position, and movement of the bending arm from the first position to the intermediate position releases the lever to permit the biasing means to slide the shaft to the unclamped position.

2. The apparatus of claim 1, wherein said mandrel second side wall lower portion is sloped at an angle of approximately 3° from parallel to the first side wall.

3. The apparatus of claim 1, wherein the groove in said block have a generally V-shaped cross-section.

4. The apparatus of claim 1, wherein said biasing means includes a spring mounted on said shaft between said bracket rearward wall and the forward end of said shaft.

5. The apparatus of claim 1, further comprising guide means connected to said mandrel and support bracket, for guiding a vertically oriented rod into the rod receiving space.

6. The apparatus of claim 5, wherein said guide means includes:

a first guide member mounted on the front surface of the mandrel, having a sloped surface sloping towards the rod receiving space; and a second guide member mounted on a front face of the support bracket, with a sloped surface sloping towards the rod receiving space;

said sloped surfaces of said first and second guide members being opposed in orientation.

* * * * *